US005915509A

United States Patent [19]

Faas et al.

[11] Patent Number: 5,915,509

[45] Date of Patent: Jun. 29, 1999

[54] METHOD AND DEVICE FOR REGULATING THE SLIVER IN A CARD

[75] Inventors: Jürg Faas, Andelfingen; Christian Müller, Winterthur, both of Switzerland

[73] Assignee: Maschinenfabrik Rieter AG, Winterthur, Switzerland

[21] Appl. No.: 08/824,479

[22] Filed: Feb. 26, 1997

[30] Foreign Application Priority Data

Apr. 5, 1996 [CH] Switzerland ..... 872/96

[51] Int. Cl.[6] ..... D01G 15/00

[52] U.S. Cl. ..... 19/98; 19/105; 19/106 R

[58] Field of Search ..... 19/98, 105, 106 R

[56] References Cited

U.S. PATENT DOCUMENTS

| | | | |
|---|---|---|---|
| 4,494,204 | 1/1985 | Hosel | 19/105 |
| 4,497,086 | 2/1985 | Guse et al. . | |
| 4,530,134 | 7/1985 | Hosel | 19/105 |
| 4,854,011 | 8/1989 | Steheli et al. | 19/105 |
| 4,955,266 | 9/1990 | Staheli et al. | 19/105 |
| 4,993,120 | 2/1991 | Staheli | 19/105 |
| 5,014,395 | 5/1991 | Staheli et al. | 19/98 |
| 5,152,033 | 10/1992 | White . | |
| 5,287,600 | 2/1994 | Wespi | 19/105 |
| 5,374,885 | 12/1994 | Küppers et al. . | |
| 5,398,380 | 3/1995 | Leifeld | 19/98 |

FOREIGN PATENT DOCUMENTS

| | | | |
|---|---|---|---|
| 271115 | 6/1988 | European Pat. Off. | 19/105 |
| 0701012A1 | 3/1996 | European Pat. Off. . | |
| 0790338A2 | 8/1997 | European Pat. Off. . | |
| 3143285A1 | 5/1983 | Germany . | |
| 3104931 | 5/1991 | Japan | 19/98 |

OTHER PUBLICATIONS

Patent Abstract of Japan, Publication No. 61289135, Published Dec. 19, 1986.

European Patent Office Search Report, Mar. 31, 1998

*Primary Examiner*—William Stryjewski

*Attorney, Agent, or Firm*—Dority & Manning, P.A.

[57] ABSTRACT

A method and device for controlling a card with a feed roll, a doffer, and a control wherein the feed roll is controlled relative to the doffer in such a way that during running up or braking transitory (transient) phenomenon in the formation of a sliver are at least partially compensated for by controlling the relative speeds of the feed roll and doffer during the running up or braking periods.

13 Claims, 5 Drawing Sheets

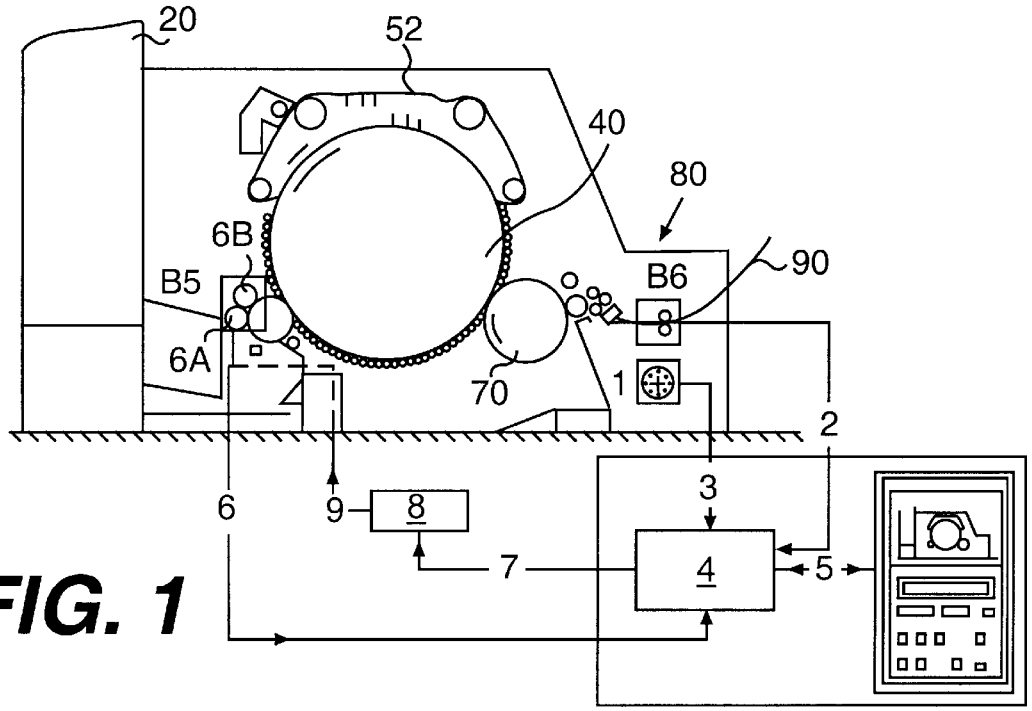
FIG. 1
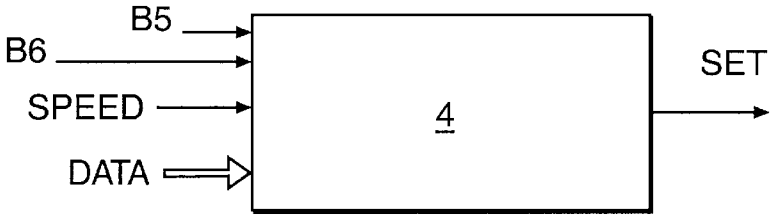
FIG. 2
FIG. 3
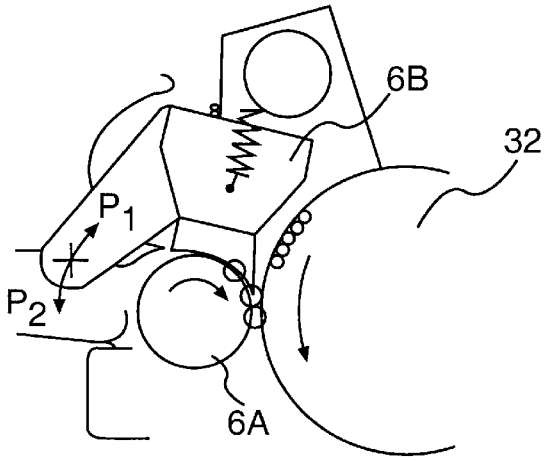

METHOD AND DEVICE FOR REGULATING THE SLIVER IN A CARD

BACKGROUND OF THE INVENTION

The invention concerns a method and a device for regulating the sliver in a card, that is a machine having a main cylinder provided with a clothing which cooperates with working elements (for example travelling flats) distributed around the circumference of the main cylinder. The cooperation of the main cylinder clothing with these operating elements generates a carding effect. A machine of this kind also comprises a material feed with, for example a licker-in and a feed roll, the rate of revolutions of the feed roll being controllable. The machine also comprises a so-called delivery section including a doffer which takes a fibre web from the main cylinder and transfers it to the machine outlet.

The invention relates to a method and a device for controlling a card during a so-called "transient" phase, that is during a period in which the delivery speed is being changed. Examples of such phases are the acceleration phase during running up to operating speed, the braking phase during stopping of the card and the corresponding acceleration phases (positive and negative) during can changing.

The conventional procedure during running up to speed and braking will subsequently be described in more detail with reference to the figures. This procedure serves as an example of a "transient" phase, the other transient phases proceeding correspondingly.

As is known, however, this procedure, which is still conventional, leads to an "unstable" fibre flow, in particular in the delivery section of the card. Up until now, this fact led to two unfavourable effects:

1. It is not possible to subject this unstable fibre flow to a regulating step, and
2. the changes in the fibre flow over time can produce a sliver break, which necessitates a renewed threading up operation (with a subsequent transient phase).

OBJECTS OF THE INVENTION

An object of the invention consists in improving the controlled procedure during a transient phase in such a manner that sliver breaks can be avoided.

A secondary object (of the preferred embodiment) consists in improving the procedure in such a manner that a regulator can be applied during the transient phase.

Additional objects and advantages of the invention will be set forth in part in the following description, or may be obvious from the description, or may be learned through practice of the invention.

In the following, the invention will be described in greater detail by reference to the exemplary embodiments illustrated in the drawings.

BRIEF DESCRIPTION OF THE DRAWINGS

FIG. 1 shows schematically a known card with sensors for sliver regulation,

FIG. 2 shows schematically a sliver regulating device,

FIG. 3 shows schematically a measuring element in the feed section (at the feed roll) of the card.

DETAILED DESCRIPTION OF THE PREFERRED EMBODIMENTS

Figure 4:
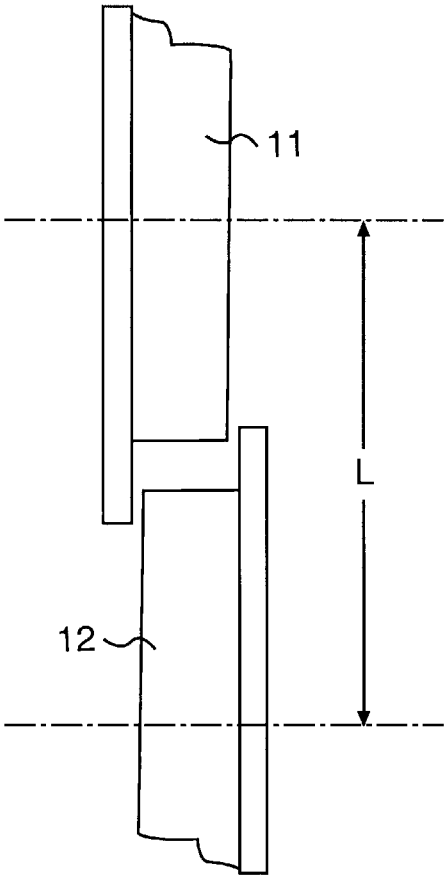
FIG. 4 shows a side view of a measuring device in the delivery section, this measuring device being formed as a stepped roll arrangement.

Reference will now be made in detail to the presently preferred embodiments of the invention, one or more examples of which are illustrated in the drawings. Each example is provided by way of explanation of the invention, and are not meant as limitations of the invention.

In the FIG. 1, a revolving flat card known as such, e.g. the card C50 built by Maschinenfabrik Rieter AG, is shown schematically. The fibre material to be processed is fed in the form of opened and cleaned fibre flocks into the chute feed 20, is taken over as a lap by a taker-in 32 (FIG. 3), also called licker-in, is transferred to a main drum 40, and is opened and cleaned between the cooperating main drum and a set of revolving flats 52. The flats of the set of revolving flats 52 are guided, driven by a suitable drive system, along a closed path (in the same direction of the main drum rotation or in the opposite direction). Fibres from the web located in the main drum 40 are taken off by a doffer roll 70 and in a delivery roll arrangement 80 are formed into a card sliver 90. This card sliver 90 is deposited by a coiler device (not shown) into a transport can in cycloid windings.

The sliver delivered by the card to the next-following processing stage, for example to the draw frame, should be as even as possible. A sliver regulating device is necessary for this purpose. Such a device will now be explained with reference to FIGS. 2 to 6.

FIG. 2 shows schematically a computer 4 with input and output signals. Signals are fed in from two sensors B5 and B6, which will be subsequently explained in greater detail. Further signals are fed in to represent, amongst other things, the speed of the card sliver at the delivery (Va) and various data, for example a set value for the sliver weight. The basic principle of a conventional sliver regulation is based on two regulating steps, namely a "long term" regulation and regulation with a "short term addition" at the infeed where disturbing influences at the time of feeding in can be compensated. According to this invention, a third step is taken, but this step will be explained in further detail only after an explanation of the conventional system.

As is apparent from FIG. 1, the sensor B5, which is provided at the feed shoe 6B, detects irregularities in the weight of the batt which is running into the card. These irregularities are represented by movements of the pivotally mounted feed shoe relative to the feed roll 6A (see also FIG. 3). The sensor B5, as illustrated in FIG. 1, delivers to the computer 4 a signal 6 which is dependent upon the cross section of the batt received by the card. The control electronics generate the signal 7 to influence the drive motor (not shown) of the feed roll 6A by way of a control device 8, thereby influencing the rate of revolutions of the feed roll.

Figure 5:
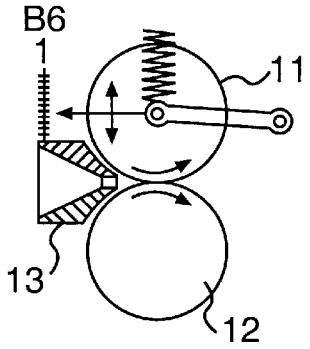
FIG. 5 shows a section through a measuring device in the delivery section of the card.
Figure 6:
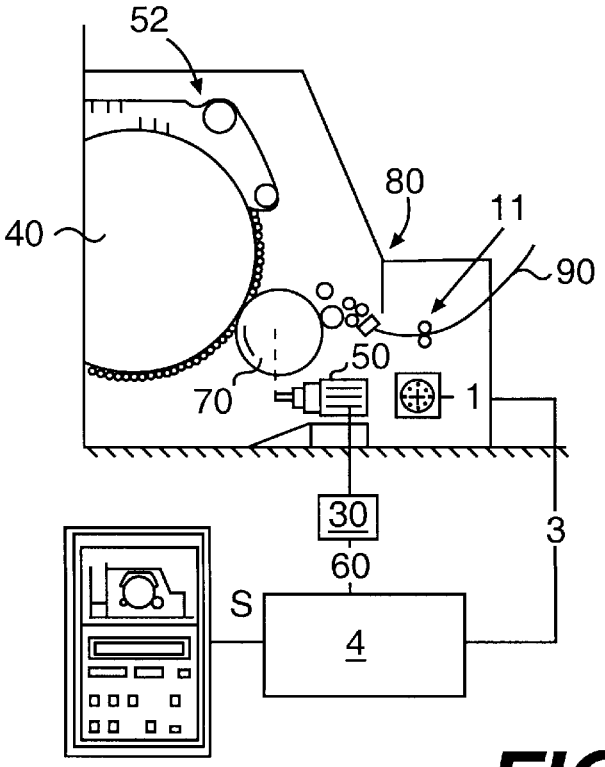
FIG. 6 shows schematically a known card with the sensor for the delivery speed of the card sliver.

The sensor B6, (also shown in FIG. 1) responds to the card sliver at the delivery and sends to the regulating device (the computer) 4 an electrical signal 2 which is dependent upon the sliver weight. By way of a trumpet 13 (see FIG. 5), the card sliver leaving the take off is guided to the nipping point of two stepped rolls 11,12 (FIG. 5). The lower roll 12 is driven, while the upper roll 11 is vertically moveable by means of a spring-loaded lever. This roll is driven by the delivered card sliver and the lift of the roll 11 (represented by the distance L) between the axes of the two rollers in FIG. 4 corresponds to the thickness of the card sliver. After a sliver break, the new sliver must be threaded through the trumpet 13, between the rolls 11,12 and then passed to the coiler. This is carried out at a relatively low, constant delivery speed ("creep speed").

An effective (actual) value is fed to the computer 4 as an input signal 2 independent of the delivery speed, and is compared with the sliver weight set value previously fed into the electronics—see also FIG. 2. The rate of revolutions of the feed roll is correspondingly influenced by the control device in order to hold constant the sliver weight at the delivery.

The sensor B5 sends measured values used by the computer C4 for the short term superposition, while sensor B6 sends measured values which are used by the computer 4 for long term regulation. In connection with the long term regulation, it is necessary to take account of the "dead time" of the control path, i.e. the time which elapses after a change at the feed roll until the corresponding effect appears at the measuring point (at sensor B6). This dead time is so long in the card that long term regulation is used only for control of sliver count (to avoid drift).

The dead time from the feed roll to the measuring point B6 is of secondary importance in connection with the present invention. However, a corresponding (shorter, but nonetheless significant) dead time arises for the path between the feed roll and the point of transfer from the main cylinder 40 to the doffer 70. This latter dead time is of central importance in connection with the invention; it will be discussed further in the description of FIGS. 7,8 and 9.

At the time of the change in the set value (i.e. during a transient phase, for example during running up or running down of the card), the delivery speed is controlled by a control loop. This serves to set correspondingly the rate of revolutions of the delivery drive motor 50 in FIG. 6. The initiator 1 (FIG. 1) on the step rollers 11,12 feeds pulses to the computer 4. These are converted into the speed of the delivery section (VAuslauf). This speed is compared with a predetermined delivery speed, see FIG. 2. The resulting adjusting value 60 is fed to a frequency converter 30 in FIG. 6.

The known sliver regulating device comes into operation only after the operating condition has been achieved, provided that this condition necessitates a delivery speed greater than 50 m/min. Below 50 m/min, and also during running up and braking, the card is switched automatically into unregulated operation, that is the short term addition and the long term regulation are inactive. The invention is directed to improvements at this point. It relates to a sliver regulation for use during running up and running down phases of the delivery speed. The invention will first be explained by reference to the diagrams in FIGS. 7,8 and 9.

Figure 7A:
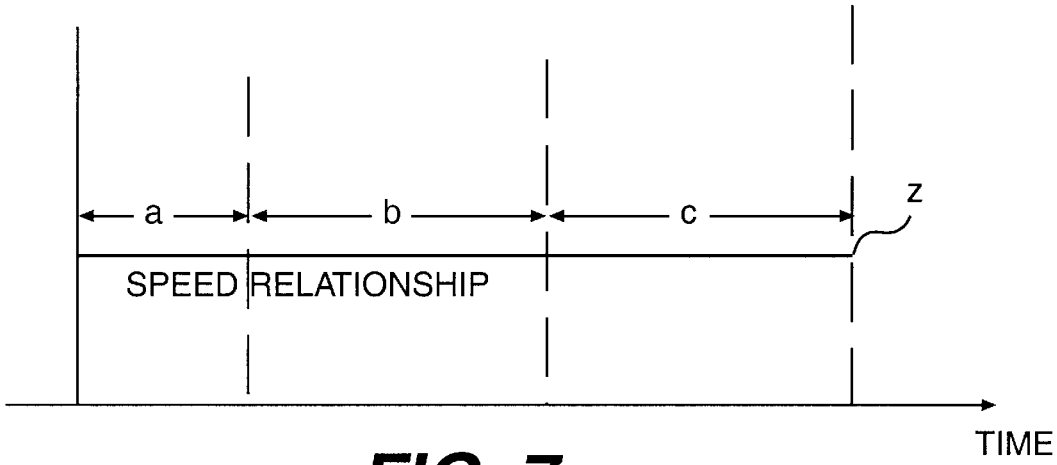
FIGS. 7–7*c* show three diagrams, the diagram (7*a*) representing the state of the art and the diagrams (7*b*) and (7*c*) representing two embodiments of the invention.

All three diagrams in FIG. 7 represent the changes over time in the relationship of the revolutions of the doffer in comparison with those of the feed roll, in particular (as an example) during running up of the card from standstill.

The first two sections of the procedure are the same in all diagrams (7*a*), (7*b*) and (7*c*), that is during the first acceleration (section a) to the end of the creep speed phase (section b) where threading up at constant (low) delivery speed is effected. In all three cases, a constant relationship has been selected between the rate of revolutions of the feed roll and those of the doffer. According to the state of the art (diagram 7*a*) the same relationship is maintained during further acceleration from the creep speed up to the operating speed (section c).

Figure 7B:
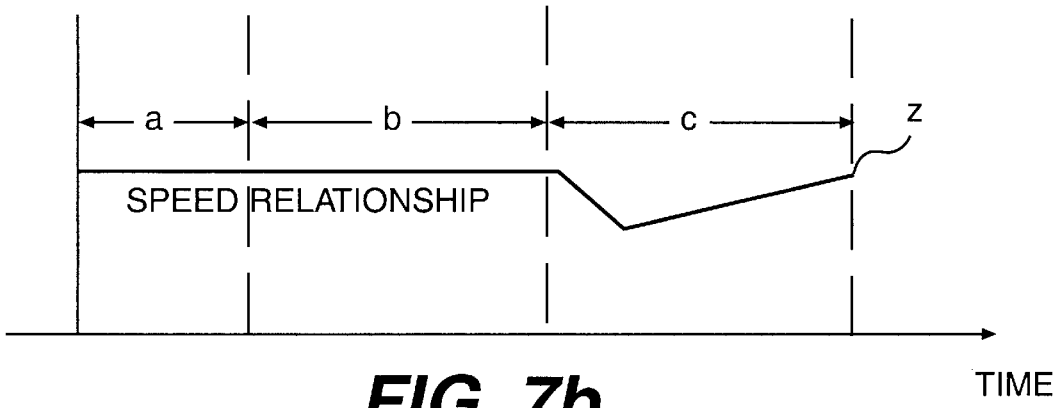
Figure 7C:
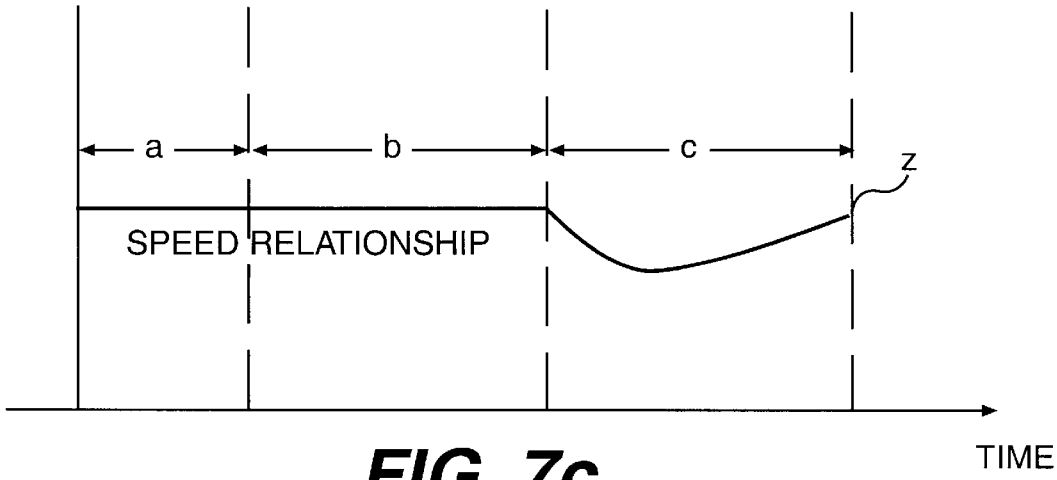

In FIG. 7–7*b*, in section c, there is at first a step-like change in the said relationship (with a sharp bend), for example because running up of the doffer is delayed in comparison with running up of the feed roll. In FIG. 7–7*c*there is no step-like change in section c but instead a continual variation in the relationship which at first exhibits a declining tendency (a somewhat slower running up of the doffer with simultaneous starting of the running up operation for both rolls).

It should be noted that in all three diagrams this relationship is the same at the time of reaching the operating speed, because the relationship represents an important technological parameter, namely the basic draft of the machine. In diagrams (7*b*) and (7*c*) section (c) must be non-linear because after the fall at the start of this section the final goal Z can only be reached by means of a curve or bend of the characteristic.

Figure 8:
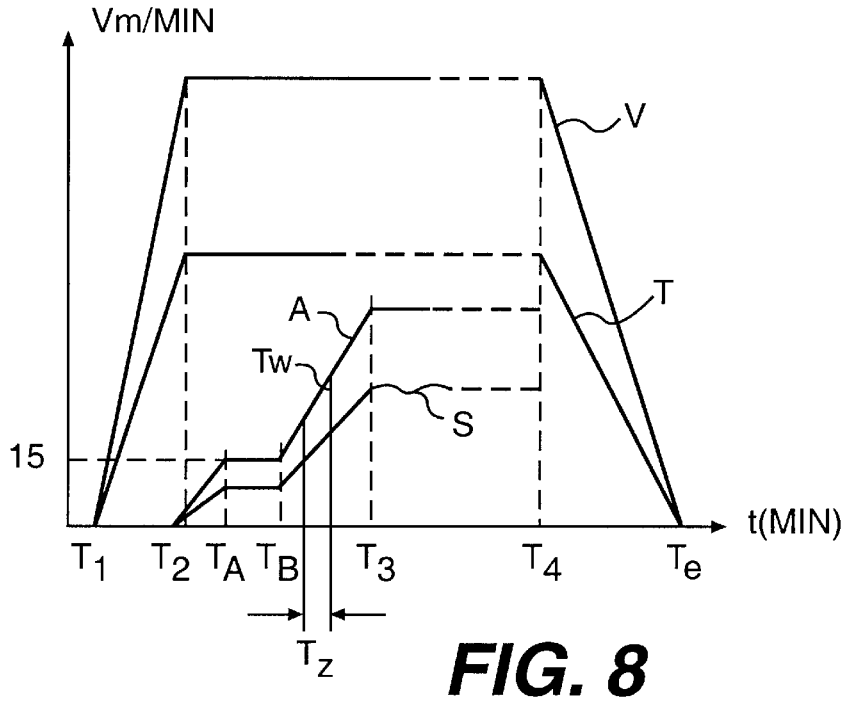
FIG. 8 shows a time/speed diagram for the running up procedure of various rolls of the card according to FIG. 1.

FIG. 8 is a time diagram for the climb in the speeds of a card during a so-called interim phase, for example in a phase during which the various rollers have not yet reached their operating speeds after switching on of the machine. The curves S and A show the rising speed of the feed roll 6A and of the doffer 70, while curves T and V represent the rising speeds of the main cylinder 40 and of the licker-in.

The previously mentioned interim phase is, for example, apparent on the abscissa between the points in time T2 and T3 for the feed roller and the doffer. In the same way, a braking procedure represents an interim phase, for example as shown on the previously mentioned abscissa between the time point T4 and Te for the main cylinder and the licker-in.

Also, FIG. 8 shows the sequence in which the individual rollers of a card are switched on. First, the main cylinder 40 is switched on, see curve T, and thereafter the doffer 70 and the feed roll 6A, see curves A and S. From the previous patent application of the applicant EP-A-701 012, it is known that in the card a separate asynchronous drive motor can be provided for the feed roll 6A, another for the main cylinder 40 (by means of which motor the licker-in and the travelling flats are also driven) and a separate asynchronous drive motor can be provided for the delivery 80 (including the doffer 70). Furthermore, it is apparent from this diagram that at time point T2 on the abscissa, at which time the feed roll and the doffer begin to run up to speed, the main cylinder and the licker-in are already at (or at least close to) their operating speed. Furthermore, a comparison of the curves A and S shows that the rate of rise in speed of the doffer is greater than that of the feed roll before these two rollers have reached their stable operating speeds. The two characteristics exhibit nevertheless a linear (proportional) relationship between the rate of revolutions of the feed roll and that of the doffer. Furthermore, in each of the curves S and A, a short time interval TA, TB is apparent in which the speeds of the doffer and the feed roll remain constant. This time interval is necessary in the course of an interim phase for threading up, that is for feeding of the card sliver between the take-off and the trumpet after a sliver break.

Figure 9:
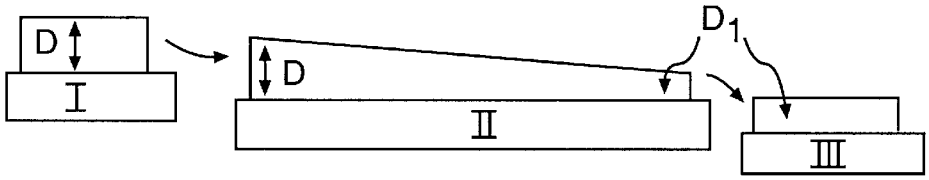
FIG. 9 is a schematic illustration of the effect of the "dead time" in the card according to FIG. 1.

As will now be explained by reference to FIG. 8 and 9, the dead time between the feed roll 6A and the doffer 70 in a card according to FIG. 1 leads to the result that during the running up phase, also referred to as the acceleration phase, the sliver quality is poor. In particular, the sliver is much thinner than is necessary, so that there is always a risk of sliver breaks. FIG. 8 shows in particular schematically the "dead time" in the formation of a card sliver from an infeed. The references I, II and III illustrate schematically the effects of the feed roll (6A), licker-in and main cylinder (32,40) and the delivery (80). In order to simplify the illustration and explanation, no account has been taken of the draft (i.e. speed changes from roll to roll) in FIG. 9. The illustrated effects are those arising directly from changes in speed in the course of running up.

At some point in time, e.g. at time Tw (FIG. 8) during running up, the feed roll passes to the licker-in and the main cylinder a fibre web (from a feed batt) with a cross section D. FIG. 9 now represents a "snapshot" of the fibre flow through the card at the same point in time Tw. Due to the previously mentioned dead time Tz from the feed roll 6A to point of transfer from the main cylinder 40 to the doffer 70, the thickness of the fibre layer at the transfer point at time Tw does not correspond to D, but to D1 (D1<D). This smaller thickness corresponds to the web which was fed from the feed roll to the licker-in 32 at an earlier point in time Tw–Tz, but which only becomes effective at the point of transfer to the doffer 70 at time Tw. At time Tw–Tz, the doffer operated (according to FIG. 8) at a rate of revolutions such that it could remove and pass on from the main cylinder a fibre layer corresponding to thickness D1. However, at time Tw the doffer is already operating at a higher rate of revolutions. Accordingly, the rapidly rotating doffer "tries" to remove more material than is made available to it. In this way, a thin sliver is formed in the delivery, with a sliver weight beneath the set weight (compare the characteristic represented by the curve K2 in FIG. 10). A similar (but inverse) problem arises in the braking phase, compare the right hand side of the diagram in FIG. 10, in which a card sliver is produced which is too thick as will be subsequently explained.

An important reason for the weakening of the sliver therefore lies in the delay time (known in control technology as "dead time") which a fibre requires (on average) to pass from the feed roll to the doffer.

Figure 10:
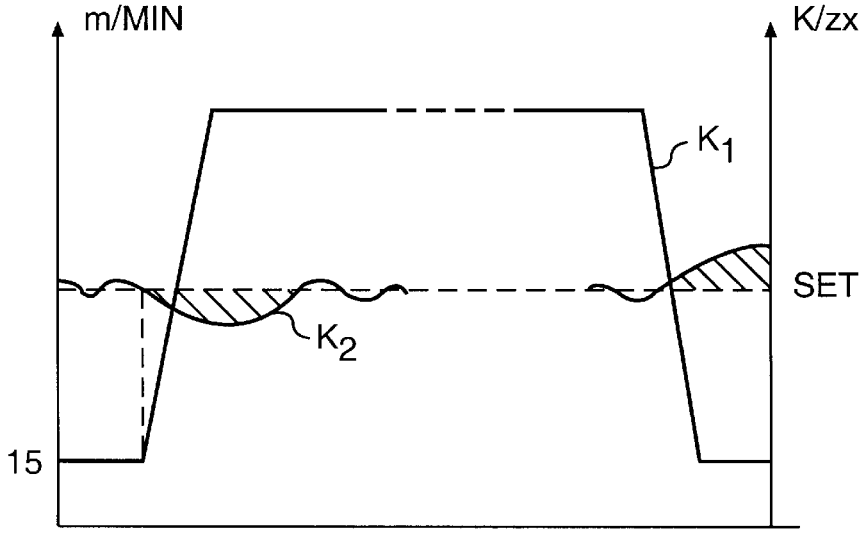
FIG. 10 shows a time/speed diagram for use in explanation of the changes in the sliver weight during acceleration of the card from or deceleration of the card to the so-called creep speed.

FIG. 10 represents a running up and braking curve K1 for the speed of the sliver and a curve K2 for the sliver thickness. The speed VA of the sliver is shown on the left ordinate, and the sliver weight in kilotex is shown on the right ordinate: The abscissa represents the time for the running up procedure or for the braking procedure. Furthermore, the set value for the sliver thickness is represented. As is apparent, an undesired sliver formation arises in this case for running up, that is from a delivery speed of the sliver in a region 15 m/sec up to the operating speed. During this period, a sliver is produced with a weight below the set value. From the right hand side of the diagram it is apparent, that during the braking procedure also an undesired (too thick) sliver is produced. These problems are to be eliminated by means of the present invention.

Two alternative solutions are proposed, as will now be explained with reference to FIGS. 11 and 12. These Figures illustrate only the procedure for running up, but these solutions can be adapted for the braking phase.

The first embodiment involves a mutual shift in the speeds of the rollers of the infeed and delivery. In other words, the running up of the speed of the doffer 70 in the delivery is delayed in such manner relative to the running up of the speed of the feed roll 6A in the infeed that the doffer 70 begins its running up at a later point in time. Thus, in the critical period of running up, the feed roll 6A will be able to deliver more material to the main cylinder 40. This prevents a condition arising at any point in time during taking off of a web from the surface of the main cylinder such that that surface carries a layer of fibre with a thickness less than the thickness corresponding to the then current rate of revolutions of the doffer. Rather, a material layer with an adequate thickness D will be present so that the web transferred to the doffer is not "thinned-out". In FIG. 10, the delay is shown with the curves VE and VA. Curve VE shows the rise in the speed at the infeed, and curve VA the rise in the speed of the delivery. The speed VE begins to rise at time point TI and continues until it achieves its predetermined value (during normal operation of the machine) at the point of time TIII. The speed VA begins however to rise at a later point in time TII and thus achieves its predetermined value at a later point in time TIV. Thus, there is a delay TI, TII on the abscissa t. As previously mentioned in the explanations regarding FIG. 8, the adjustment of the speeds of the two rollers begins only at the point in time TI (not at time origin T0) because the time period T0–TI is necessary for threading up of the sliver in the region of the trumpet.

The above described procedure is effected by sending a signal 7 from the computer 4 (represented in FIGS. 1 and 2) at the time point TI to the drive motor of the feed roll, and sending a signal 60 at a later point in time TII to the drive motor 50 of the doffer. In order to avoid repetition, reference is made to the sliver regulating devices already described with reference to FIGS. 1 to 5. This already represented procedure is pre-programmed into the computer 4 and is delivered to the user with a software package.

In a further embodiment of the invention (FIG. 12) the speed VE of the feed roll 6A is accelerated more strongly relative to that VA of the doffer 70 during the critical phase. This procedure is explained by reference to FIG. 12. In contrast to the procedure represented in FIG. 11, the influence on the speeds of the two rollers begins for both the infeed and the delivery at the same point in time TG. While the speed of the feed roll VE climbs strongly at this point in time, the acceleration of the doffer is relatively slow in the time interval TG–TG1, that is it begins to climb strongly only at the time point TG1. Further, it is apparent from this diagram that the regulation of the feed roll is undertaken from a delivery speed of the sliver in the region of 0.15 m/min and that of the doffer from a speed in the region of 15 m/min. This procedure is carried out in such manner that the computer delivers signals 7 and 60 to the drive motors of the two rollers at the same point in time TG. The rate of rise of the two movement characteristics are pre-programmed.

Figure 11:
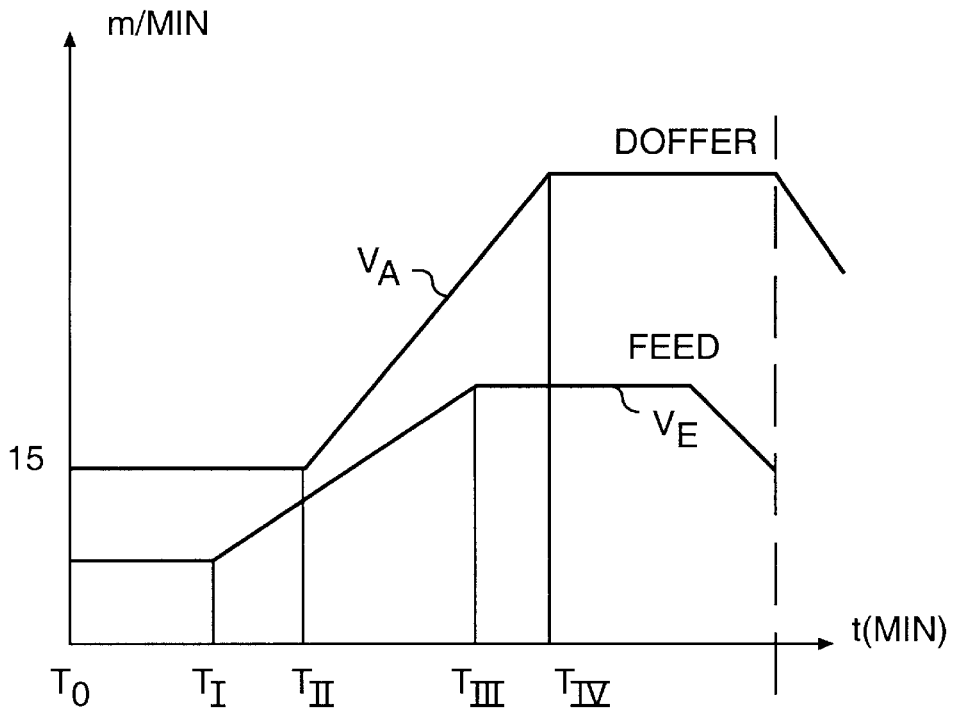
FIG. 11 illustrates a first principle according to the invention.
Figure 12:
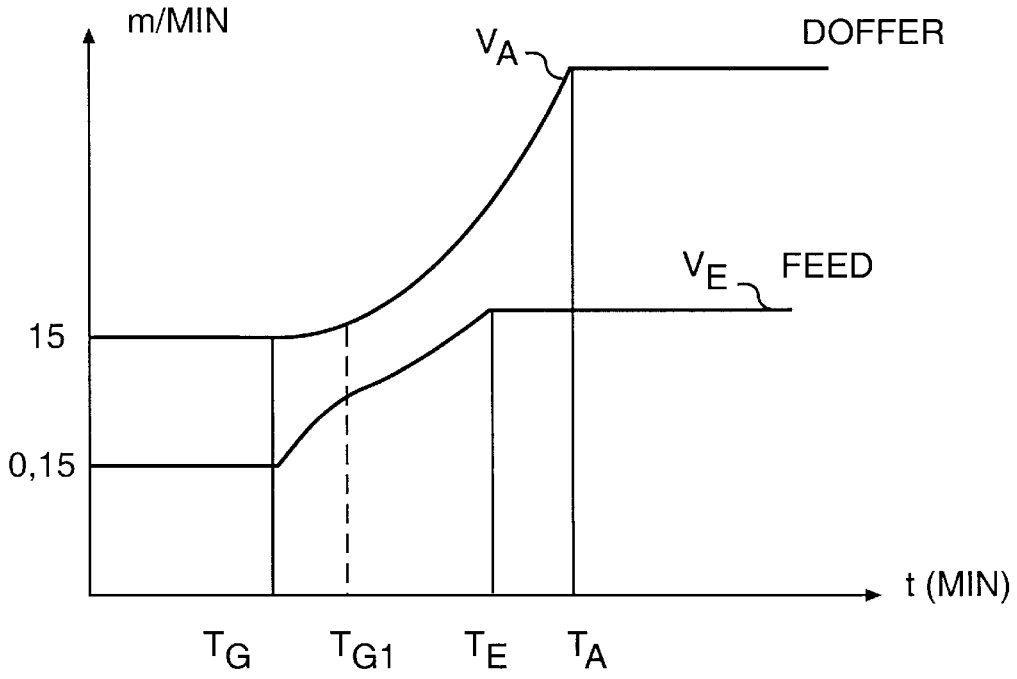
FIG. 12 illustrates a further principle according to the invention.

As already indicated the procedures, according to FIGS. 11 and 12 can also be adapted for running down. In accordance with the solution represented in FIG. 11, the slowing down of the rate of revolutions of the feed roll required for running down of the machine is initiated at an earlier point in time than the corresponding step for the delivery section 80. In accordance with the solution represented in FIG. 12, the computer 4 initiates deceleration of the doffer 70 (the delivery section 80) at the same point in time as deceleration of the feed roll begins, but the "braking curve" for the feed roll is steeper than the braking curve for the delivery section.

A further practical application of the invention will now be described.

The cylinders of the delivery section 80 are coordinated relative to each other in such manner that the fibre web formed at the point of transfer from the main cylinder 40 to the doffer 70 is removed from the latter at the region of transfer to the subsequent cylinder (the stripping roller) and thereafter is fed forward as a web until this web is collected to form a sliver 90. The cylinders of the feed section are coordinated in a corresponding manner so that the fibre web drawn out of the batt by the feed roll 6A is passed on at each transfer region as a web until the fibres reach the main cylinder 40.

The procedure at the point of transfer from the main cylinder 40 to the doffer 70 is however different from that described for the other transfer regions. In transfer from the main cylinder to the doffer, only a proportion of the fibres pass to the doffer, the others continue their travel with the surface of the main cylinder [(see for example EP patent application No 97810074.1 of Dec. 2, 1997)]. The fibre layer on the doffer, which is decisive for the sliver weight, depends on a number of factors, of which only two are of importance at this point of the description, namely from

- the thickness of the fibre layer on the main cylinder 40, and
- from the circumferential speed of the doffer 70 in relationship to this circumferential speed of the main cylinder 40.

The thicker the fibre layer on the main cylinder, the thicker will be the fibre layer on the doffer (for otherwise predetermined operating parameters). The lower the circumferential speed of the doffer relative to the circumferential speed of the main cylinder (for otherwise predetermined operating parameters), the thicker will be the fibre layer on the doffer.

A predetermined sliver weight necessitates a corresponding web thickness on the doffer. In order to ensure this, the two parameters mentioned above have to be matched to each other, as was explained with reference to FIGS. 9 and 10 in the case of running up. In that case, the "over-rapid" doffer drew out the "few" available fibres to an undesirable degree and thereby thinned them out. This can lead to a sliver break. An "underspeed" doffer causes a jam in the fibre flow, which can lead to a blockage.

Assume now that at a predetermined point in time Tk the delivery speed must be reduced from its value for normal operation to a lower value, and then must be increased once again to the operational speed, in order to carry out a can changing operation. At some predetermined point in time, the set value for the delivery speed will be reduced in accordance with a predetermined "braking ramp", and this will effect an immediate deceleration of the doffer 70. The main cylinder 40, however, continues to run at an unchanged rate of revolutions (circumferential speed). Furthermore, the main cylinder 40 is still feeding a layer of fibres to the doffer 70 that was fed in by the feed roll 6A at a point in time Tk–Tz (see FIG. 8). The rate of revolutions of the feed roll 6A is, of course, also reduced at time Tk. However, due to the dead time, this change cannot produce any simultaneous effects at the point of transfer to the doffer.

The result is a significant thickening of the fibre layer on the doffer, (giving a significant increase in the sliver weight t).

If the long-term regulation device remains switched on and detects the change in the sliver weight, it will cause a further deceleration in the rate of revolutions of the feed roll in order to reduce the flow of fibres to the main cylinder (causing a thinning out of the fibre layer on the main cylinder). Due to the previously mentioned "dead-time", the influence of the reduced feed appears on the surface of the main cylinder only after a delay—in the meantime, however, the rate of revolutions of the doffer has been reduced still further in accordance with the braking ramp. The sliver weight is, therefore, (in spite of the efforts of the regulation) still too high.

At the completion of the can change procedure, the delivery speed is increased again in order to return the card to the set production (normal operating condition). The circumferential speed of the doffer therefore rises relative to the circumferential speed of the main cylinder, the doffer takes a smaller proportion of the fibre layer from the main cylinder, and at the same time this fibre layer has been thinned out for reasons mentioned already in relation to the normal operating condition. The thickness of the fibre layer on the doffer thereby decreases. The long-term regulation cannot effectively compensate this effect because of the dead time. Also, the control algorithm of the long-term regulator (in the software or programming of the computer 4) normally comprises an integral component. Up till now, fibre flow changes during a transient phase have interrelated with this integral component of the algorithm in such a way that the error tends to increase before it can be corrected. Accordingly, the long-term regulation has up until now been switched off during running up and running down phases (that is during transient phases), because it does not correct variation in the sliver weight but actually makes compensation more difficult.

The disadvantageous effects arise during a conventional change in the delivery speed because a change of this kind leads immediately to a change in a relationship between the circumferential speeds of the main cylinder and the doffer. As already explained, with otherwise given operating parameters, a change in this relationship must lead to a change in the sliver weight. However, it is not possible to change the other relevant parameters "immediately". In accordance with this invention, the flow of fibres to the main cylinder can be "precontrolled" in order to reduce the undesired effects. This can be carried out because

- the flow of fibres can be influenced by way of the rate of revolutions of the feed roll,
- the "dead time" (the time delay between a change in the revolutions of the feed roll and the corresponding influence at the transfer position between the main cylinder and the doffer) can be established, and
- the point in time of a change in the set value for the speed of the doffer is "known in advance" (preprogrammed) in the computer control.

By means of the precontrol of the fibre flow, the thickness of the fibre layer on the main cylinder can be changed over time in such manner that the subsequent influence of a "transient" change in the delivery speed on the sliver weight (on the doffing of fibres from the main cylinder) is at least partially compensated. The exact precontrol characteristic must be determined (empirically) in dependence upon the details of the card design, that is in dependence upon the effective dead time from the feed roll to the doffing location, and on the effective change in the "collection capability" of the doffer for a given change in its rate of revolutions. Since these factors themselves can be dependent upon other operating parameters (for example on the effective operating speed of the main cylinder (see e.g. DE 31 43 285), other effects may also have to be taken into account in the control programming. However, the complexity of the system should preferably not be increased unnecessarily (only those parameters should be taken into account which exert a significant influence).

By means of this precontrol, it is in any event possible to improve the fibre flow during the transient phases in such manner that sliver breaks can be avoided. However, the invention enables a further improvement—the fibre flow can be stabilized to such an extent that the long term regulation does not produce a disturbing effect but rather an improvement in the sliver evenness even during a transient phase. The computer 4 can therefore be programmed so that the long term regulation is switched on (made active) even during running up (after completion of the creep phase). Furthermore, the long term regulation can remain switched on during braking down to a corresponding delivery speed. The long term regulation can also remain active during can changing.

A further improvement in the evenness of the band can be achieved e.g. in that the long-term regulation can be switched on from a delivery speed of approximately 35 m/min.

The present invention is in no way limited to the above mentioned embodiments which are shown purely by way of example. In particular, it is not limited to running up from the creep phase, running down to a stationary condition or to can changing. Basically, the control (the computer) 4 can be programmed in such a way that it recognizes an impending transient phase (for example by means of a change in the set value for the delivery speed) and it initiates a corresponding precontrol of the fibre flow through control of the rate of revolutions of the feed roller.

Accordingly, it will be obvious to those skilled in the art that various modifications and variations can be made in the invention without departing from the scope and spirit of the invention. It is intended that the present invention cover such modifications and variations as come within the scope of the appended claims and their equivalents.

We claim:

1. A method for controlling a card having a doffer and feed roll with respective drives so as to minimize undesired thick or thin spots produced in a sliver during transitory periods of operational speed changes of the card wherein the feed roll slows down or speeds up causing a corresponding decrease or increase in the rate of fiber infeed to the card, said method comprising:

controlling the drives of the doffer and feed rolls during the transitory periods to generate a varying draft between the doffer roll and the feed roll during the transitory period such that during an acceleration transitory period wherein the feed roll increases in speed, the speed relationship of the doffer roll and feed roll is controlled so that the difference between the speeds of the doffer roll and feed roll initially decreases and subsequently increases until the doffer roll and feed roll are at operational speed; and such that during a braking transitory period wherein the feed roll decreases in speed, the speed relationship of the doffer roll and the feed roll is controlled so that the difference between the speeds of the doffer roll and feed roll initially increases and subsequently decreases.

2. The method as in claim 1, comprising controlling the drives of the doffer and feed rolls during the transitory periods by a control program of the card.

3. The method as in claim 1, comprising delaying an increase in speed of the doffer roll relative to that of the feed roll in an acceleration transitory period.

4. The method as in claim 3, further comprising maintaining the rate of speed change the same for the doffer and feed roll after said delaying.

5. The method as in claim 1, comprising changing speeds of the feed roll and doffer roll at a same point in time while varying the rate of speed change between the feed roll and doffer roll in an acceleration and braking transitory period.

6. A card machine, comprising:

a main cylinder, and a feed roll disposed for delivering a fiber material to said main cylinder:

a doffer disposed for receiving fiber material from said main cylinder:

controllable drive devices operably connected with said feed roll and said doffer;

a control system configured with said drive devices, said control system configured to drive said doffer and feed roll during transient non-operational speed phases of said card such that during an acceleration transitory period wherein said feed roll increases in speed, the difference between the speeds of said doffer roll and feed roll initially decreases and subsequently increases until said doffer roll and feed roll are at operational speed; and such that during a braking transitory period wherein said feed roll decreases in speed, a corresponding decrease in speed of said doffer roll is controlled so that the difference between the speeds of said doffer roll and feed roll initially increases and subsequently decreases.

7. The card machine as in claim 6, wherein said control system comprises a regulating device, and a sensor operably disposed relative to said feed rolls to generate a signal indicating sliver weight, said regulating device receiving said signal and generating a drive control signal controlling said feed rolls in dependance upon sliver weight.

8. The card machine as in claim 7, wherein said regulating device comprises a computer and integrated operating algorithm.

9. The card machine as in claim 7, wherein said regulating device is activated during said transitory phases.

10. A card machine comprising a feed roll and a doffer, and a control system operably connected to controllable drives of said feed roll and said doffer for controlling relative speed changes between said feed roll and said doffer during transient running up or braking phases of said card machine so that undesired thick or thin spots in a fiber sliver processed by said card machine are minimized during said transient phases, said control system configured such that during said running up transitory period wherein said feed roll increases in speed, said doffer and feed rolls are controlled so that the difference between the speeds of said doffer roll and feed roll initially decreases and subsequently increases until said doffer roll and feed roll are at operational speed; and such that during said braking transitory period wherein said feed roll decreases in speed, said doffer and feed rolls are controlled so that the difference between the speeds of said doffer roll and feed roll initially increases and subsequently decreases.

11. The card machine as in claim 10, wherein said control system comprises a computer generating control signals for said drives to vary the rates at which said doffer and feed roll run up to an operational speed and slow down from the operational speed during said transient phases.

12. The card machine as in claim 11, wherein said computer delays relative starting or stopping times of said doffer and said feed roll during said transient phases.

13. The card machine as in claim 11, wherein said computer varies relative acceleration or deceleration of doffer and said feed roll during said transient phases.

* * * * *